United States Patent [19]

Manerba

[11] Patent Number: 4,963,037

[45] Date of Patent: Oct. 16, 1990

[54] CONTAINER FOR LOOSE PRODUCTS IN GENERAL, PROVIDED WITH RAISING MEANS, ADAPTED TO BE STORED EITHER IN A HORIZONTAL OR IN A VERTICAL POSITION

[76] Inventor: Giancarlo Manerba, Via per Cittiglio, Laveno Mombello, Italy

[21] Appl. No.: 370,531

[22] Filed: Jun. 23, 1989

[51] Int. Cl.[5] ..... B65D 33/14

[52] U.S. Cl. ..... 383/24; 383/16; 383/67

[58] Field of Search ..... 383/16, 24, 67, 32, 383/104, 22

[56] References Cited

U.S. PATENT DOCUMENTS

| | | | |
|---|---|---|---|
| 2,696,235 | 12/1954 | Toffolon | 383/67 X |
| 3.949,901 | 4/1976 | Tokita | 383/67 X |
| 4,356,853 | 11/1982 | Sekiguchi | 383/24 |
| 4,390,051 | 6/1983 | Cuthbertson | 383/67 X |
| 4,802,773 | 2/1989 | Gross | 383/16 |

FOREIGN PATENT DOCUMENTS

| | | | |
|---|---|---|---|
| 1004540 | 3/1957 | Fed. Rep. of Germany | 383/16 |
| 915999 | 1/1963 | United Kingdom | 383/22 |
| 952511 | 3/1964 | United Kingdom | 383/16 |

*Primary Examiner*—Stephen Marcus
*Assistant Examiner*—Jes F. Pascua
*Attorney, Agent, or Firm*—Bucknam and Archer

[57] ABSTRACT

A container for loose products in general, capable of being raised, adapted to be stored either in a horizontal or in a vertical position, comprises a holding body of elongated parallelepipedal shape, made of a high strength fabric and provided, on its opposite bases, with a discharging outlet and a loading inlet, on one of the bases, there being provided closed loop strips for vertically raising the container whereas, on the outer surface of the holding body, there are provided holding straps encompassed by strap restraining rings and adapted to be used for raising horizontally the container.

3 Claims, 2 Drawing Sheets

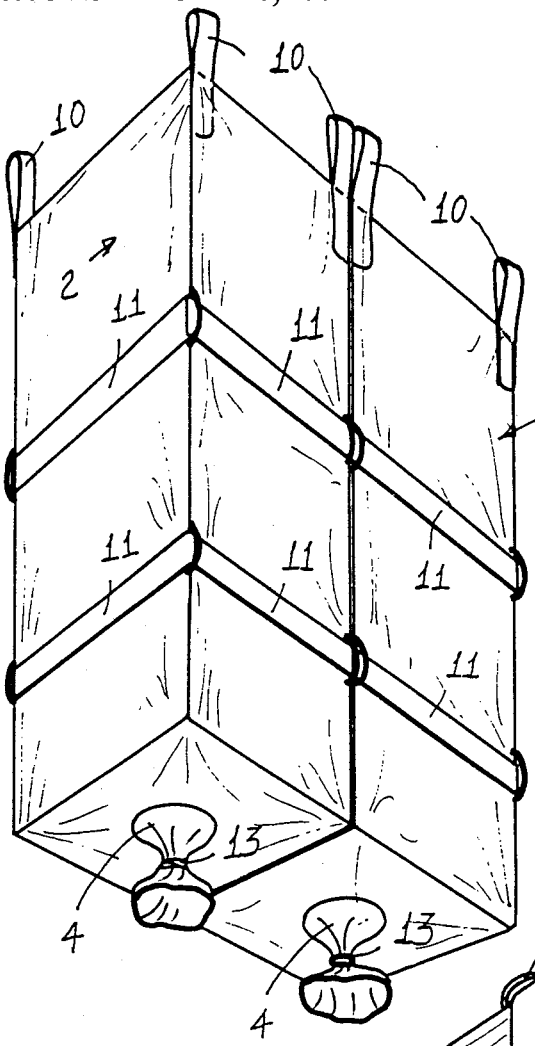
Fig. 2
Fig. 1
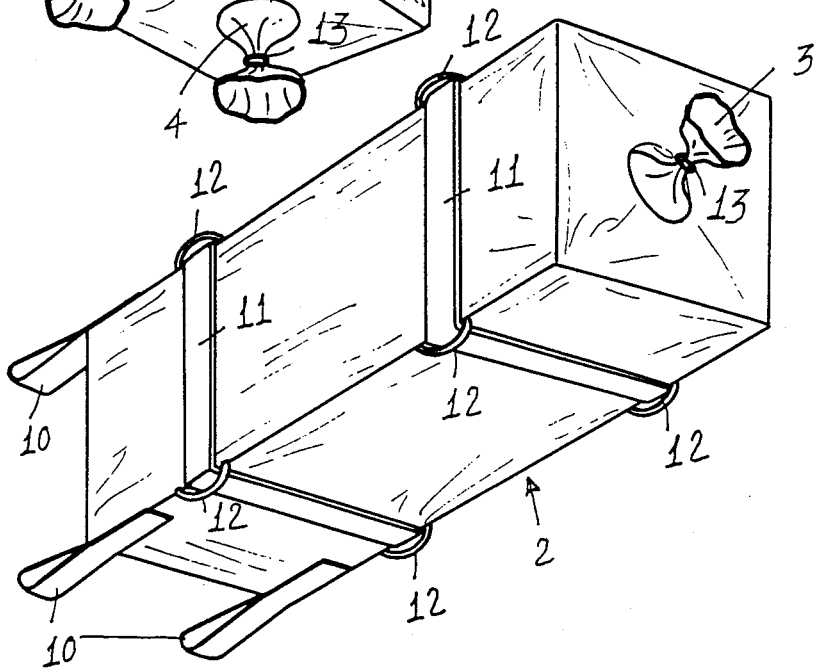

CONTAINER FOR LOOSE PRODUCTS IN GENERAL, PROVIDED WITH RAISING MEANS, ADAPTED TO BE STORED EITHER IN A HORIZONTAL OR IN A VERTICAL POSITION

BACKGROUND OF THE INVENTION

The present invention relates to a container for loose products in general, which is provided with raising means and is adapted to be stored either in a horizontal or in a vertical position.

As is known, several different types of containers are commercially available for holding loose products or materials in general, the containers or vessels usually comprise an elongated parallelepipedal shape holding body which, at the base portions thereof, is respectively provided with a loading inlet and a discharging outlet.

Moreover, on the base including the loading inlet there are provided closed loop straps adapted to be engaged for vertically raising and displacing the container.

These containers can be stored or stacked exclusively in a vertical position, because of their elongated parallelepipedal shape, however it is not possible to stack onto one another a plurality of containers in a horizontal position.

SUMMARY OF THE INVENTION

Accordingly, the main object of the present invention is to overcome the above mentioned drawbacks, by providing such a parallele-pipedal container for loose products or materials in general which can be raised both in a vertical position and in a horizontal position so as to be stacked, or stored, if desired, in both said positions.

Another object of the present invention is to provide such a parallele-pipedal container for loose products and the like which can be easily handled by conventional fork lifting devices and which, moreover, has a comparatively high strength so as to preserve its size.

Another object of the present invention is to provide such a parallele-pipedal container which is very safe and reliable in operation and which, moreover, can be made starting from easily commercially available elements and materials, at a comparatively low cost.

According to one aspect of the present invention, the above mentioned objects, as well as yet other objects, which will become more apparent thereinafter, are achieved by a parallele-pipedal container for loose products in general, including raising means, for storing said container either in a horizontal or in a vertical position, said container comprising an elongated parallelepipedal shape holding body, made of a high strength fabric and provided, on its opposite bases, with a discharging outlet and a loading inlet.

In particular, at a base there are provided closed loop straps for vertically raising the container whereas, on the outer surface of the container holding body there are provided encompassing belts, passing through belt restraining ring members, for raising horizontally the container.

BRIEF DESCRIPTION OF THE DRAWINGS

Further characteristics and advantages of the present invention will become more apparent hereinafter from the following detailed disclosure of a preferred though not exclusive embodiment of a parallele-pipedal container for loose products in general, which is illustrated, by way of an indicative but not limitative example, in the accompanying drawings in which:

FIG. 1 is a schematic perspective view illustrating the container for loose products in general according to the present invention;

FIG. 2 is another perspective view illustrating two containers, arranged with an adjoining vertical relationship;

DESCRIPTION OF THE PREFERRED EMBODIMENT

Figure 3:
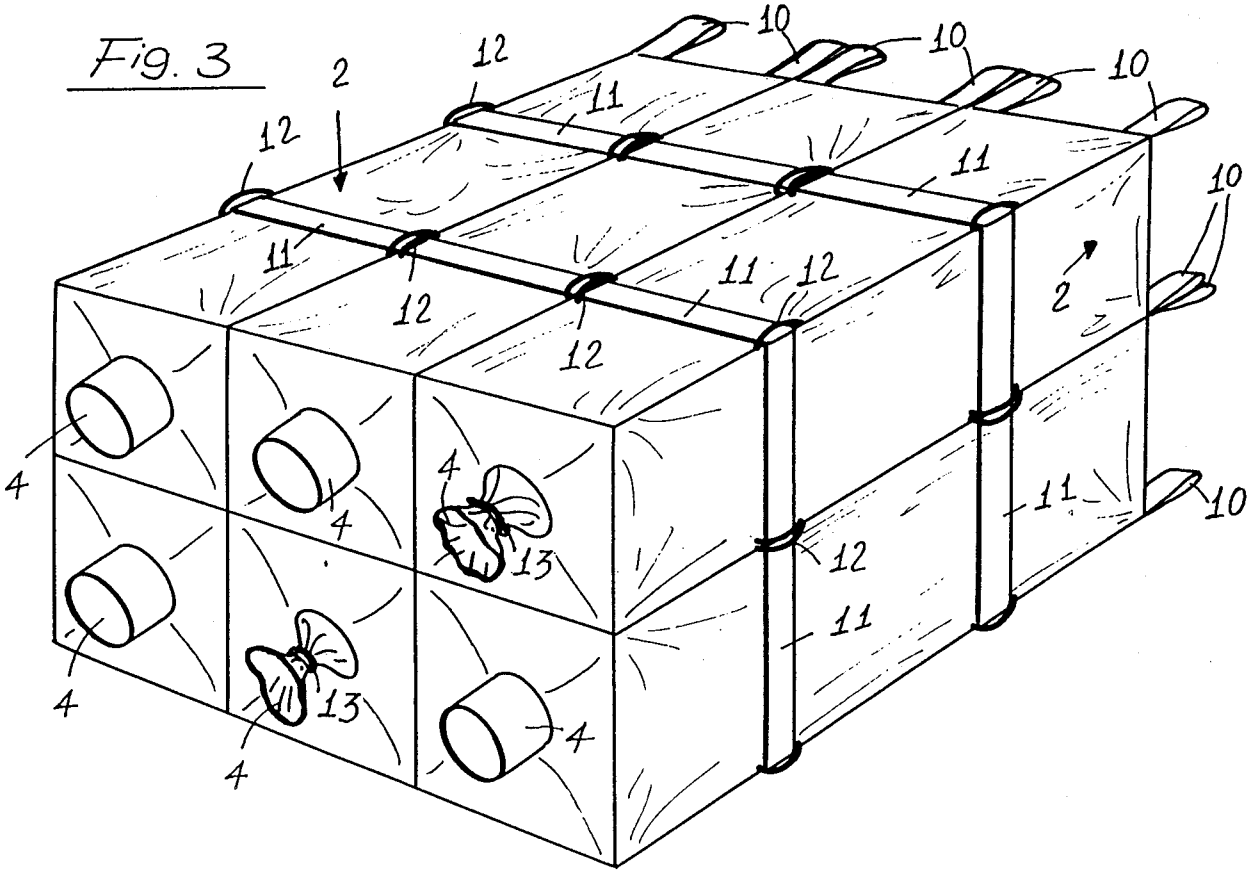
FIG. 3 illustrates a plurality of containers, arranged with a stacked horizontal relationship.

With reference to the above figures, the container for loose products in general, according to the invention, which is generally indicated at the reference number 1, comprises a holding body 2, which, has an elongated parallelepipedal shape and, at its small bases, is respectively provided with a loading inlet 3 and a discharging outlet 4.

The holding body 2 is advantageously made of a fabric or a non-woven fabric, having high strength for to resist the stresses exerted thereon by the contained material.

In particular, the above mentioned fabric may be a plasticized or thermally insulated fabric or, if desired, a multiple layer fabric the layers of which are adhesively coupled.

At a small base, preferably the base including the loading inlet 3, there are provided closed loop strips 10, affixed to the container corners, and adapted to be engaged by raising means for handling and transporting the container with a vertical attitude.

A main feature of the invention is that, on the outer surface of the holding body 2, there are provided spaced straps 11, of loop shape, which encompass the holding body and are in turn encompassed by restraining ring members 12 made of fabric materials or fibre materials, and spaced along the longitudinal corners of the container In particular, the straps 11 are adapted to be engaged by fork lifting devices, the forks whereof can be engaged between the outer surface of the container body and said straps in order to raise and transport the container 1 with a horizontal attitude, thereby affording the possibility of stacking, with this attitude, a plurality of like containers The straps 11, in addition to providing the possibility of easily handling the container in a horizontal attitude, also operate to prevent the contained material from stressing and tearing the container walls.

Accordingly, the provision of the mentioned straps affords the possibility of making well shaped containers and, moreover, affords the additional advantage that the container can be raised horizontally, and stacked in this attitude, with a remarkable reduction of the storing space.

The loading inlet 3 and discharging outlet 4 can be closed by cords or the like, 13, and may be easily opened as it is required.

From the above disclosure it should be apparent that the invention fully achieves the intended objects.

In particular, the fact is to be pointed out that the provision of the side straps affords provides a very flexible container which has a great strength and, moreover, the mentioned straps, which are firmly restrained by the ring members 12, can be easily engaged by lifting forks for easily raising and transporting, within a horizontal attitude, the single containers.

The invention as disclosed is susceptible to several modifications and variations all of which will come within the spirit and scope of the invention.

I claim:

1. A parallelepipedal container for loose products, comprising a non woven fabric, elongated parallelepipedal holding body, said holding body being defined by two opposite bases and by longitudinal sides coupling said bases, said longitudinal sides having each a substantially flat outer surface, one of said base having a closable loose material loading inlet and the other of said bases having a closable loose material discharging outlet, first lifting closed loop strip means being formed at said one base to be engaged by lifting means for lifting said container as said container rests on said other base thereof and second lifting closed loop spaced strap encompassing means encompassing at spaced positions said holding body to be engaged by said lifting means for lifting said container as said container rests on a said longitudinal side thereof, strap restraining ring means being moreover associated with the outer surface of at least a said longitudinal side for restraining said strap means in said strap restraining ring means.

2. A container according to claim 1, wherein said closed loop strip means comprise four closed loop strips arranged near corner portions of said one base and said closed loop encompassing strap means comprise two spaced encompassing straps which encompass said holding body and pass through said restraining ring means said lifting means including lifting forks adapted to be engaged between a said outer surface of a said longitudinal side and a portion of said strap means.

3. A container according to claim 1, wherein said strap restraining ring means are arranged on corner portions of said longitudinal sides.

* * * * *